United States Patent [19]

Hilfiker

[11] Patent Number: 5,076,735

[45] Date of Patent: Dec. 31, 1991

[54] WELDED WIRE COMPONENT GABIONS AND METHOD OF MAKING THE SAME AND CONSTRUCTION SOIL REINFORCED RETAINING WALLS THEREFROM

[76] Inventor: William K. Hilfiker, 5135 Blackberry, Eureka, Calif. 95501-2012

[21] Appl. No.: 575,933

[22] Filed: Aug. 31, 1990

[51] Int. Cl.[5] ..... E02D 5/00; E02D 17/20

[52] U.S. Cl. ..... 405/284; 405/258; 220/294; 220/285; 229/23 R

[58] Field of Search ..... 405/284, 286, 262, 258; 220/491, 489, 494, 492, 485; 229/23 R

[56] References Cited

U.S. PATENT DOCUMENTS

| | | | |
|---|---|---|---|
| 1,443,901 | 1/1923 | Murray | 220/485 X |
| 1,689,017 | 10/1928 | Fewkes | 220/491 X |
| 3,559,867 | 2/1971 | Muskopf | 229/23 X |
| 3,840,947 | 10/1974 | Burbidge | 220/494 |
| 4,904,124 | 2/1990 | Egan | 405/284 X |

FOREIGN PATENT DOCUMENTS

| | | | |
|---|---|---|---|
| 468856 | 10/1950 | Canada | 220/494 |
| 0136332 | 10/1980 | Japan | 405/258 |
| 0153022 | 11/1981 | Japan | 405/258 |
| 0017929 | 1/1989 | Japan | 405/258 |
| 0665862 | 6/1988 | Switzerland | 405/284 |

*Primary Examiner*—Dennis L. Taylor

*Attorney, Agent, or Firm*—Limbach, Limbach & Sutton

[57] ABSTRACT

Gabions are constructed of welded wire gridworks comprised of integrally joined planar panels disposed in angle relationship to one another. The gridworks are secured together to define a three-dimensional volume therebetween. In one embodiment the gabions are provided with soil reinforcing mats secured thereto to define a bottom for the three-dimensional volume. The mats extend laterally from the gabions and, when the gabions are assembled in tiers at the face of an earthen formation, serve as soil reinforcements for the formation.

16 Claims, 4 Drawing Sheets

WELDED WIRE COMPONENT GABIONS AND METHOD OF MAKING THE SAME AND CONSTRUCTION SOIL REINFORCED RETAINING WALLS THEREFROM

BACKGROUND OF THE INVENTION

The present invention relates to the art of gabion retaining walls for earthen formations and, more particularly, is concerned with the formation of gabion baskets from welded wire panels.

Gabion retaining walls date back to the Roman Era. The word "gabion" is derived from the Latin cavea—a cage. When used for retaining walls, such cages are filled with rocks. The earliest gabions were woven from plant fiber and were not very durable. More recent gabions have been made of twisted wire screening. The most contemporary gabions are made of welded wire panels which are secured together to form the gabion basket. The present invention is concerned with constructions of the latter type and improved welded wire gridworks which may be used to provide the gabion panels and minimize the connections required between the panels. It is also concerned with an improved gabion wherein a welded wire soil reinforcing mat may be secured to the gabion basket to form one side of the basket.

A number of techniques are used in the prior art to secure welded wire panels together for the purpose of forming gabions. Some of these use "hog rings" which are generally only intended to temporarily secure the panels in place. Others use relatively flexible wire which is wrapped or tied around the wires at the edges of the panels to secure the panels together. One of the most recent techniques is to preform helical coils of relatively rigid wire and then thread or screw these coils around the wires at the intersecting edges of the panels to secure the panels together. Such wires may also be used to join the edges of adjacent gabions together. The prior art also teaches the use of welded wire trays to form soil reinforced earthen retaining walls. Such trays may be seen, for example, in U.S. Pat. No. 4,117,686 by William K. Hilfiker, the inventor herein. In at least one embodiment, the welded wire wall of that patent includes angle shaped welded wire mats which are superimposed behind the welded wire trays to provide a barrier for containing the rocks and soil of the wall.

SUMMARY OF THE INVENTION

The present invention is concerned with a gabion wherein the components making up the gabion comprise welded wire gridworks having integrally joined panels disposed at an angle relative to one another. The gridworks are joined edge-to-edge or edge-to-corner to define a three dimensional volume or basket between the panels. Top and bottom gridworks are also provided and, in one embodiment, the bottom gridworks may take an extended form so as to serve as soil reinforcing mats. The angle shaped gridwork components may be assembled in a variety of configurations to provide independent baskets, or plural baskets which are joined to one another.

In addition to providing a gabion and components to form the gabion, the invention provides a method of constructing a retaining wall for an earthen formation through the use of the gabions. The method comprises using the angle shaped gridworks to create gabion baskets; securing soil reinforcing grids to at least certain of the gabions so as to extend laterally therefrom; assembling rock filled tiers of the gabions at the face of the earthen formation to be retained, with at least certain of the gabions having the soil reinforcing grids secured thereto and extending toward the formation; and, backfilling soil between the tiers of gabions and the earthen formation to cover the reinforcing grids and provide a soil reinforced composite wall.

A principal object of the invention is to provide gabions fabricated of welded wire gridwork components which may be assembled in a variety of ways to create a composite gabion wall with a minimum of separate connections.

Another object of the invention is to provide a welded wire gabion of increased strength and durability, as compared to twisted wire gabions, or welded wire gabions which employ individual panel elements, each of which must be separately secured at all of its edges.

Still another object of the invention is to provide a simplified method of constructing welded wire gabions which results in economy of labor and material in the construction of gabion walls.

Yet another object of the invention is to provide a welded wire gabion which may be combined with a welded wire soil reinforcing mat forming part of the gabion.

These and other objects will become more apparent when viewed in light of the following detailed description and accompanying drawings.

DESCRIPTION OF THE PREFERRED EMBODIMENTS

Figure 1:
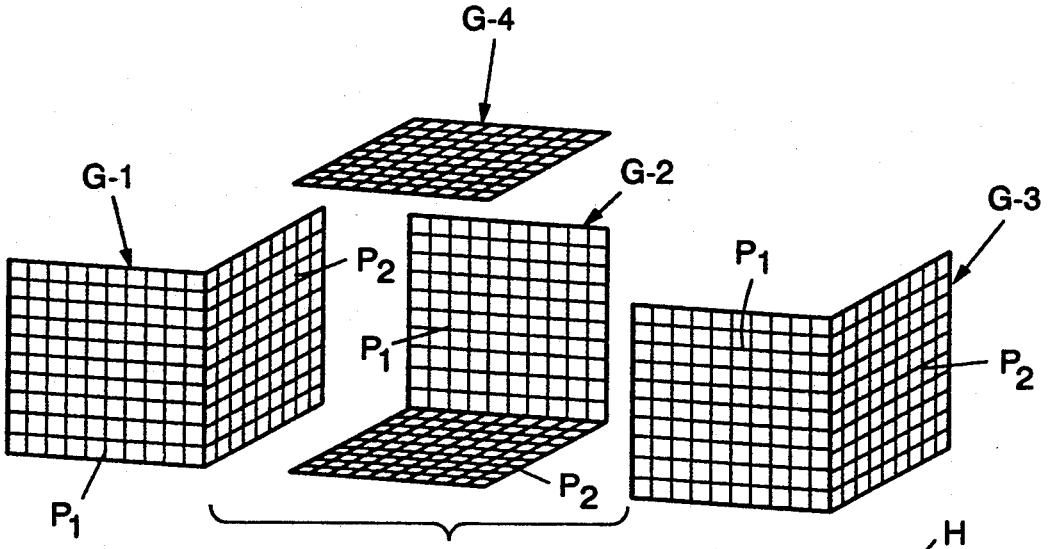
FIG. 1 is an exploded perspective view of three of the angle shaped gridwork components of the present invention, together with a planar gridwork which may be used as the top side of a gabion basket formed from the components.

Referring now to FIG. 1, first, second and third gridworks, designated G-1, G-2 and G-3, respectively, are shown. The gridworks, G-1, G-2 and G-3 correspond to one another in configuration and each comprise a pair of integrally joined panels, $P_1$ and $P_2$ joined in right angled relationship to one another. In a typical gabion according to the present invention, the gridworks G-1, G-2 and G-3 are made up of 9 or 11 gauge wire with the wire within the panels $P_1$ and $P_2$ spaced 3"×3". The dimensions are typical and may vary. For example, for special orders or very large gabion baskets, the wire gauge may be increased. The size of the panels will depend upon the size of the gabion basket. Typical baskets sizes are as follows:

3'×3'×3'

6'×6'×3'

12'×6'×3'

24'×6'×3'

These dimensions are typical and in no way intended to be limiting. The gabions shown in the drawings are square and fabricated by gridworks having 3'×3' panels. Ideally, the welded wire mesh from which the panels is fabricated is galvanized, typically 0.8 ounces per square foot.

The preferred spacing of the wires within the panels $P_1$ and $P_2$ for the gridworks making up the gabion baskets is 3"×3". Where separate welded wire soil reinforcing mats are secured to the gabions, the spacing of the wires within the gridwork of the mats is preferably 6"×9".

In FIG. 1, the three gridworks G-1, G-2 and G-3 are shown in exploded form and a fourth gridwork, G-4 comprised of a single planer panel is shown exploded thereabove. The gridwork G-4 is fabricated of galvanized welded wire stock corresponding to that from which the gridworks G-1, G-2 and G-3 are fabricated.

Figure 1A:
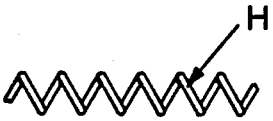
FIG. 1A illustrates one of the helical coils H used to secure the gridworks G-1 through G-4 together to form a gabion basket.

FIG. 1*a* illustrates one of the helical coils H used to secure the gridworks G-1 through G-4 together to form a gabion basket. In the assembly process, the gridworks are disposed in edge-to-edge or edge-to-corner relationship and the helical coils H are threaded around the wires which extend along the mating edges or corners.

Figure 2:
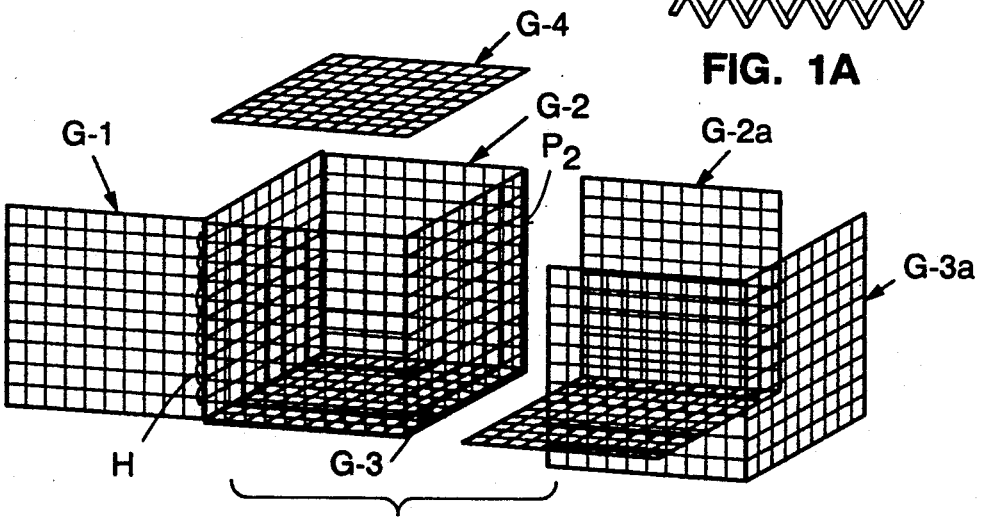
FIG. 2 is an exploded perspective view showing the three angle shaped components of FIG. 1 assembled into a gabion basket, with the planar gridwork for the top of the basket shown exploded there above and two angle shaped components for a second connected basket exploded to one side of the assembled basket.

As shown in FIG. 2, the gridworks, G-1, G-2 and G-3 are assembled together to provide a three-dimensional gabion between the panels of the gridworks. The basket thus provided has an open top. After being filled with rock, this open top would be closed by securing the gridwork G-4 in edge-to-edge relationship to top edges of the gridworks G-1, G-2 and G-3 with helical coils H. Wherever the respective gridworks meet in edge-to-edge or edge-to-corner relationship, the adjacent wires of the respective gridworks extending along the edges or corners are secured together by the helical coils H. The coils are simply screwed around the adjacent wires. Where the corner formed between the panels of a gridwork is not engaged by an adjacent gridwork, no helical coil connection between the panels of the gridwork is required. In the illustration of FIG. 1 and 2, the gridwork G-2 has such a corner.

FIG. 2 also shows gridworks G-2*a* and G-3*a* exploded to one side of the gabion basket defined by the gridworks G-1, G-2 and G-3. The gridworks G-2*a* and G-3*a* correspond in construction and dimensions to the panels G-2 and G-3. When assembled, the gridworks G-2*a* and G-3*a* are disposed against the side of the gridwork G-3 and secured in edge-to-edge and edge-to-corner relationship by helical coils H to provide a second gabion basket having a panel in common with the first gabion basket. In the illustration of FIG. 2, the common panel would be provided by the panel $P_2$ of the gridwork G-3.

Figure 3:
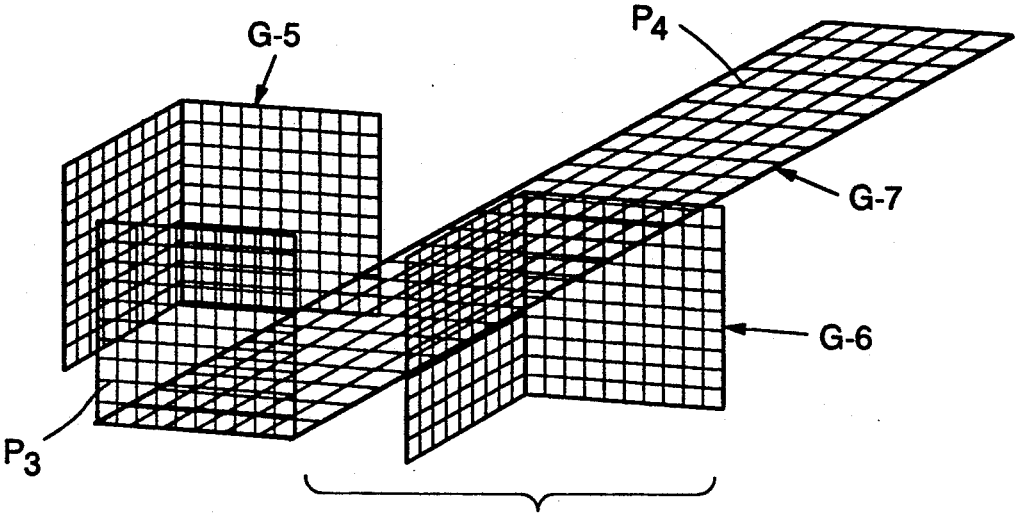
FIG. 3 is an exploded perspective view showing a gabion fabricated of three angle shaped gridwork components constructed according to the present invention, with one of the components designed to provide two sides of a gabion basket and a soil reinforcing mat.

FIG. 3 illustrates a gabion basket constructed according to the present invention where two angle shaped gridworks G-5 and G-6 corresponding in construction to the gridworks G-1, G-2 and G-3 are combined with a gridwork G-7 to provide a gabion basket having an integral soil reinforcing mat extending laterally therefrom. The gridwork G-7 comprises a face panel $P_3$ and floor panel $P_4$. The face panel $P_3$ ideally has the same 3"×3" galvanized wire and grid pattern used for the panels $P_1$ and $P_2$. While the floor panel may have this same gridwork pattern for ease of fabrication, it ideally has 6"×9" wire spacing, with the longitudinal wires of the panel spaced by 6" and the transverse wires of the panel spaced by 9".

In the assembled condition, the FIG. 3 arrangement provides a gabion basket defining a three-dimensional basket with a soil reinforcing mat secured thereto and extending from the floor of the basket. While not illustrated, it should be appreciated that the gridworks G-5, G-6 and G-7 are secured in edge-to-edge and edge-to-corner relationship with helical coils H corresponding to the coils shown in FIG. 1*a*. Once filled with rock, the gabion basket thus provided would be closed with a suitable planer gridwork, such as the gridwork G-4.

As an alternative to providing soil reinforcing mats which form part of an angle-shaped gridwork G-7, the soil reinforcing mats may take the form of flat planer gridworks which are disposed to form the bottom of a gabion basket formed by a pair of gridworks G-1 and G-3. In such an arrangement, the gridworks G-1 and G-3 would be assembled in facing edge-to-edge relationship to define a 3-dimensional volume therebetween with an open top and an open bottom. The soil reinforcing gridwork mat would be secured to provide the bottom of a gabion basket thus provided. The top of the basket would be provided by planer gridwork such as the gridwork G-4.

Figure 4:
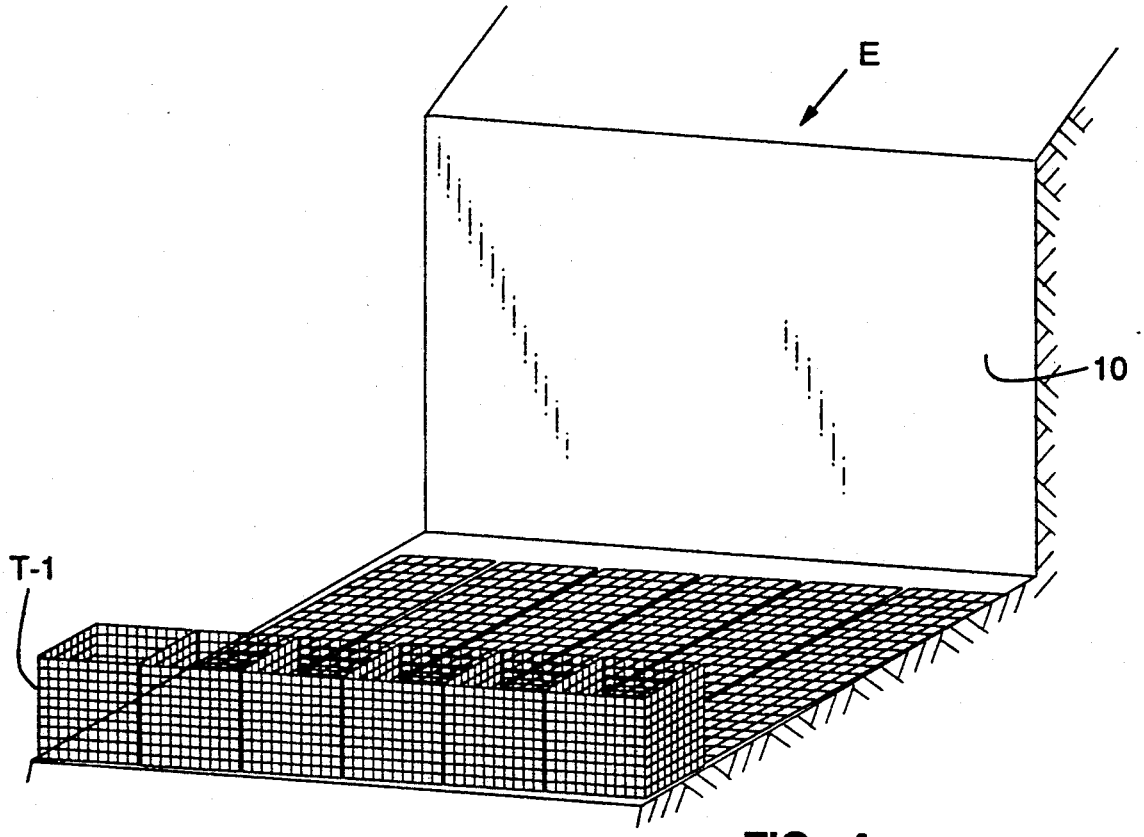
FIGS. 4, 5, 6, 7, 8 and 9 are perspective views illustrating, in sequence, how the gabions of the present invention may be used to construct a soil reinforced earthen retaining wall.

FIG. 4 illustrates the face 10 of an earthen formation E which has been excavated in preparation for retention by a soil reinforced wall fabricated according to the present invention. As there shown, a first tier T-1 of gabion baskets constructed according to the present invention is shown positioned forward of and at the base of the face 10. Each of the gabion baskets of the first tier is of the type having a soil reinforcing mat forming the bottom of the basket.

Figure 5:
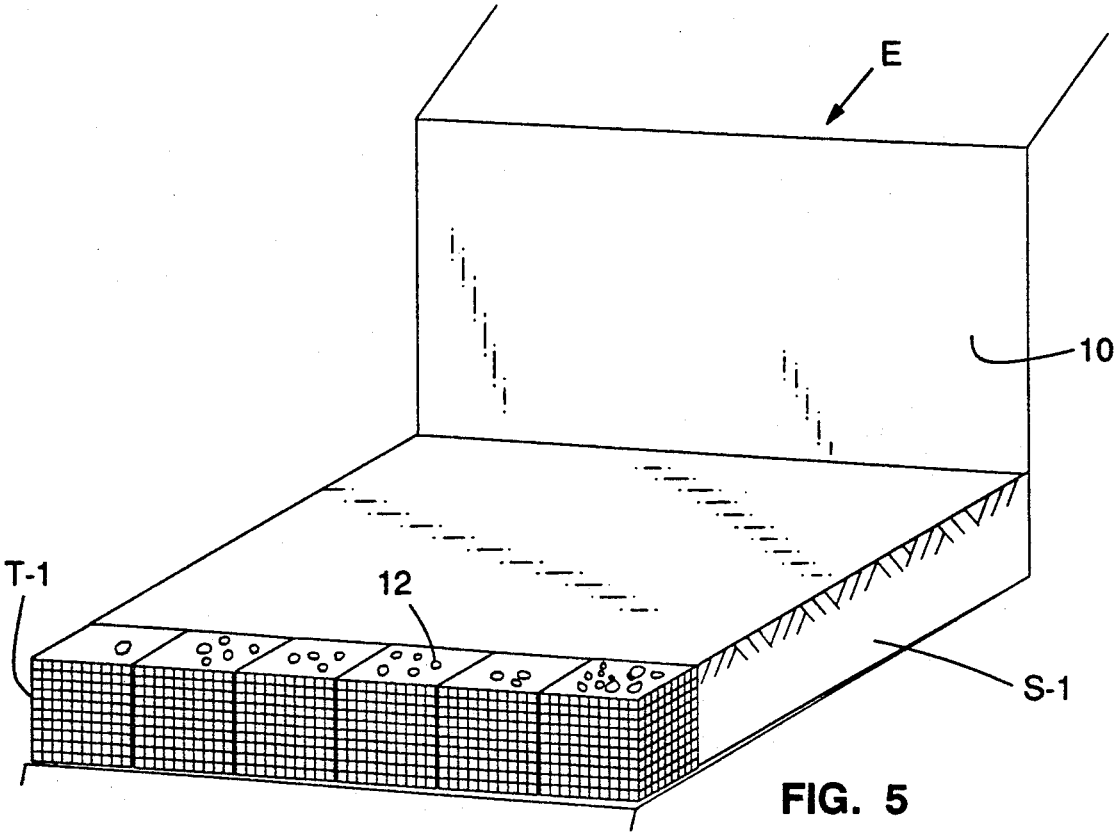

FIG. 5 shows the next successive step of forming the soil reinforced retaining wall for the earthen formation E. As there shown, the gabion baskets of the first tier T-1 have been filled with rock 12 and a first layer of soil S-1 has been backfilled over the soil reinforcing mats extending from the baskets.

Figure 6:
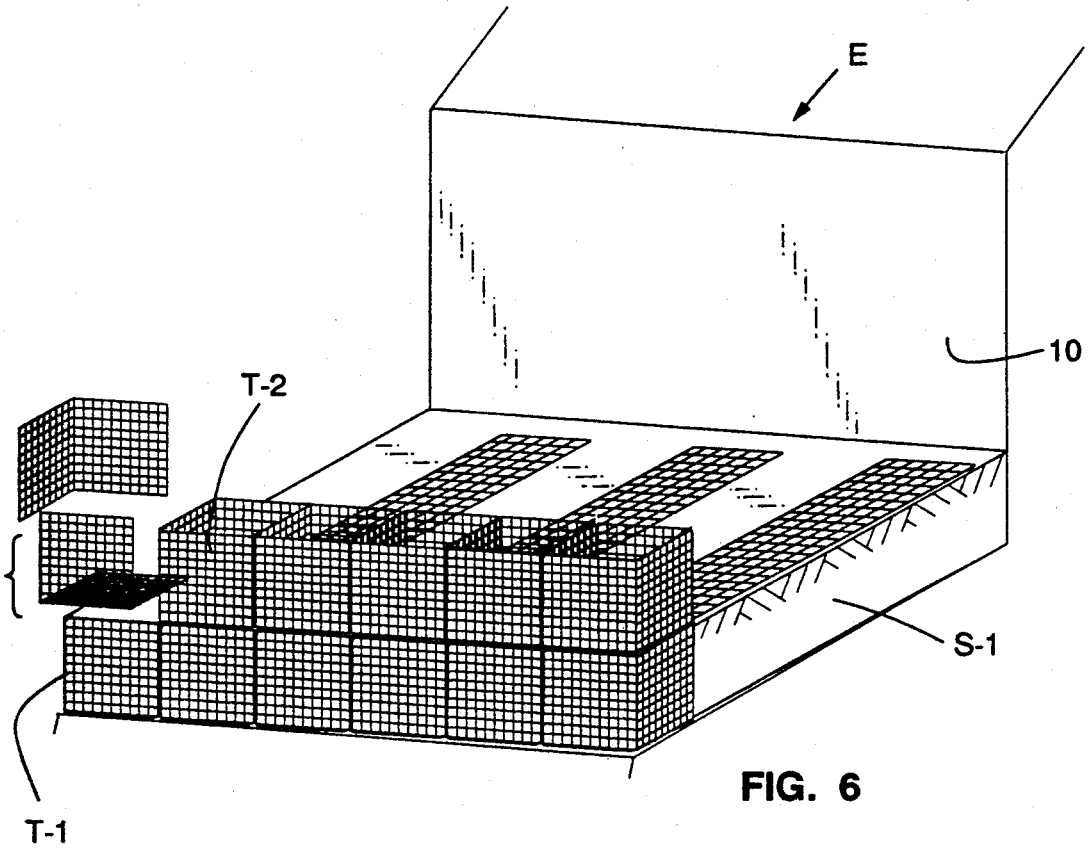

FIG. 6 shows a second tier T-2 of gabion baskets stacked above the baskets of the first tier T-1. The baskets of the tier T-2 are constructed according to the present invention, with alternate baskets having soil reinforcing mats extending therefrom toward the earthen formation.

Figure 7:
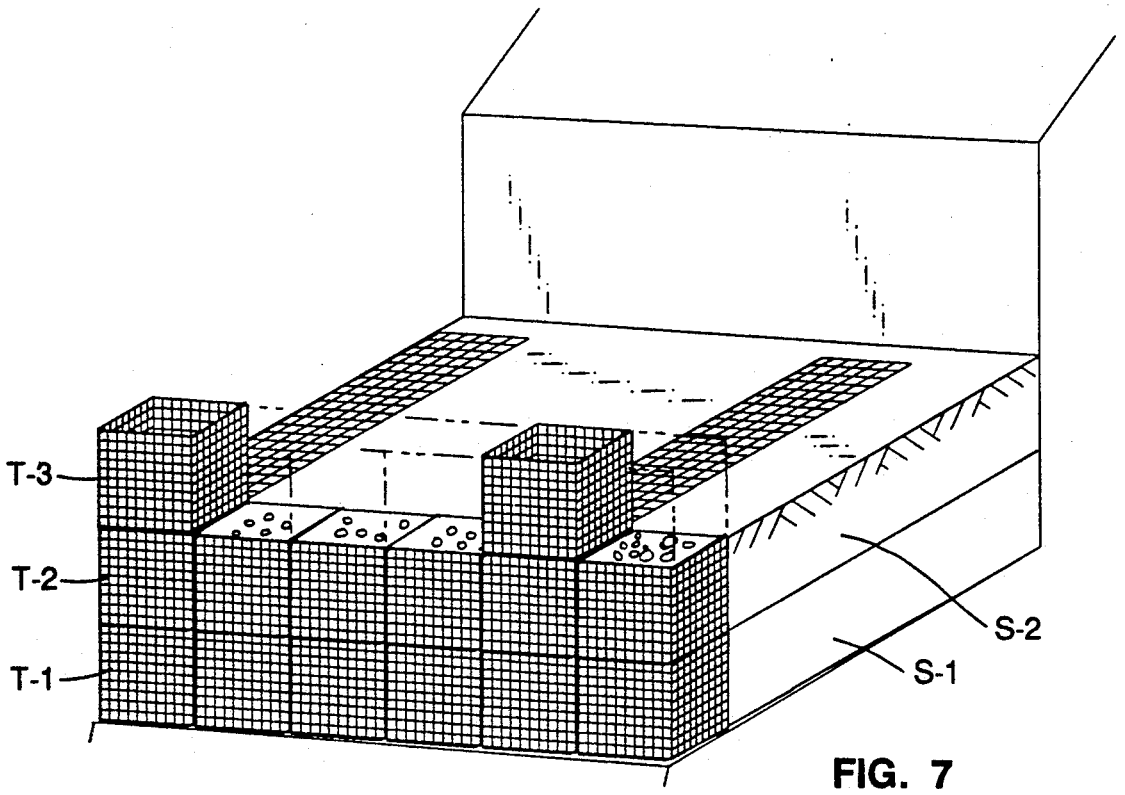

FIG. 7 shows the baskets of the second tier T-2 filled with rock 12 and a second layer of backfill soil S-2 filled in behind the gabions of the second tier and over the soil reinforcing mats thereof. As shown in FIG. 7, a third tier of gabion baskets T-3 is shown in the process of being stacked above the second tier, with reinforcing mats of the third tier disposed in staggered relationship relative to the mats of the second tier.

Figure 8:
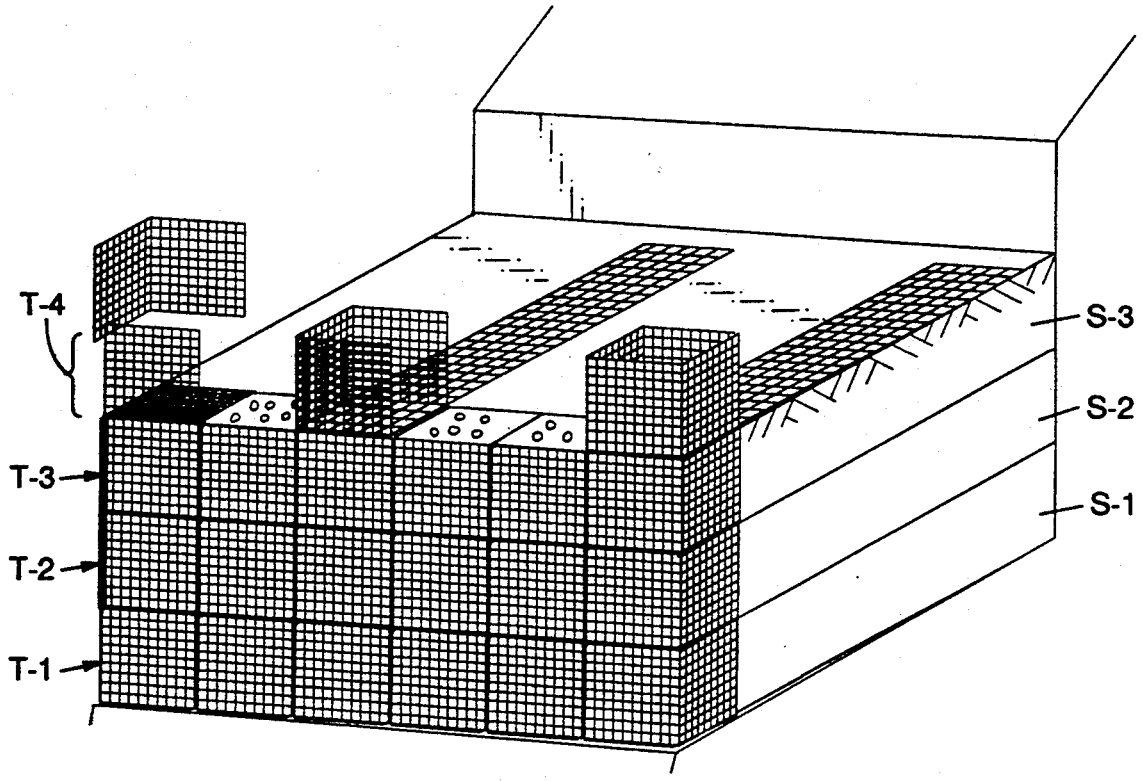

FIG. 8 shows the third tier T-3 completed, with a layer of backfill soil S-3 in place over the soil reinforcing mats of the third tier and the fourth tier T-4 in the process of being constructed over the third tier. As there shown, the gabions of the fourth tier are in the process of being constructed, with soil reinforcing mats staggered relative to the mats of the third tier.

Figure 9:
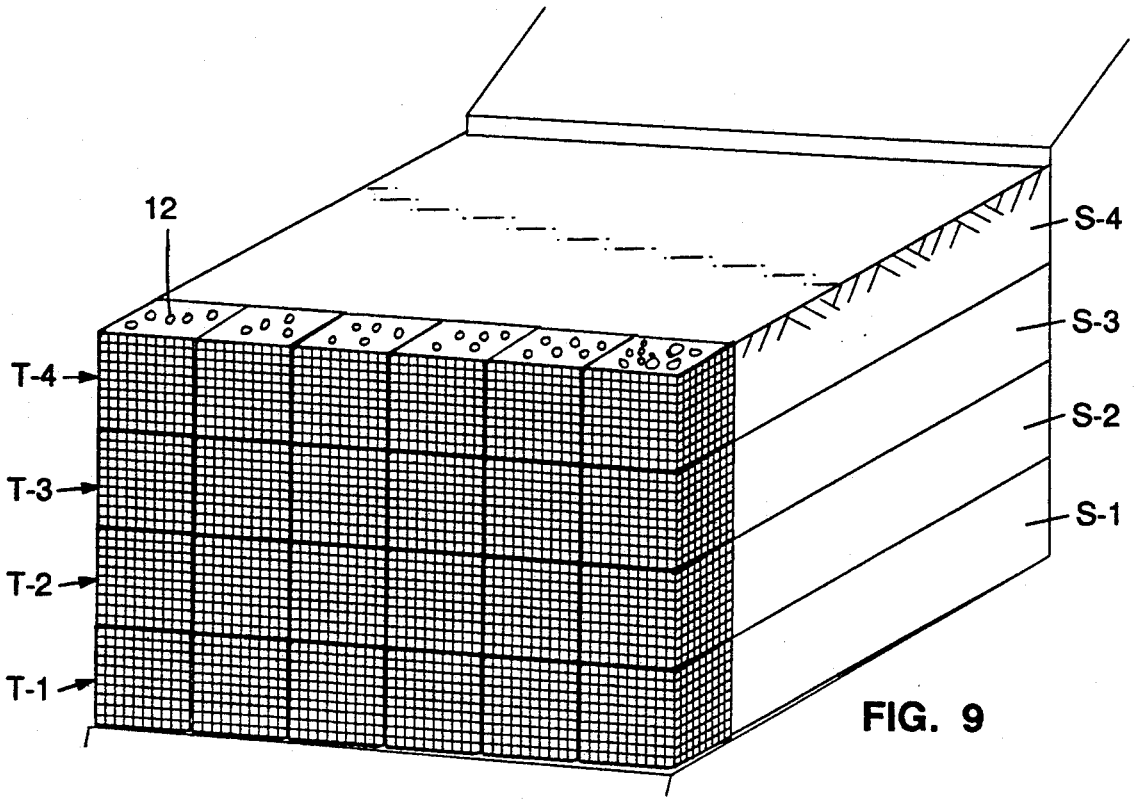

FIG. 9 shows the fourth tier completed with the baskets thereof filled with rock 12 and soil layer S-4 filled over the soil reinforcing mats. While the wall shown in FIG. 9 appears to be over square in the sense that the height of the wall is less than the length of the soil reinforcing mats, this is not typical for a fully constructed wall. The general rule of thumb is that the length of the soil reinforcing mat should be approximately 0.7 time the height of the wall. It should be appreciated that the wall shown in FIG. 9 might be provided with additional tiers of gabions to provide a soil reinforced retaining wall for the earthen formation E having this ratio.

CONCLUSION

The key to the present invention is the provision of angle-shaped welded wire gridworks which may be assembled to provide gabions while minimizing the number of separate connections which must be provided between the intersecting edges of the gabion panels. The gridworks may be assembled in a variety of ways to provide three dimensional gabion baskets and adjacent baskets may have common walls or panels. Certain of the baskets may be provided with floor panel gridworks which also provide soil reinforcing mats. When stacked in tiers to provide a soil reinforced wall, the baskets of successive tiers may rest upon one and other, without being tied together.

While preferred embodiments of the invention have been illustrated and described, it should be understood that the invention is not intended to be limited to the specifics of these embodiments, but rather as defined by the accompanying claims.

I claim:

1. A combination of elements for forming gabions, said combination comprising:

(a) a first welded wire gridwork comprised of two planar panels, said panels being disposed in right angled relationship to one another and having integrally joined proximal edges defining a corner therebetween, said panels each being of rectangular configuration, having a free distal edge in spaced relationship to said corner, said side edges extending between said proximal and distal edges;

(b) a second welded wire gridwork comprised of two planar panels, said panels being disposed in right angled relationship to one another and having integrally joined proximal edges defining a corner therebetween, said panels each being of rectangular configuration, having a free distal edge in spaced relationship to said corner, and side edges extending between said proximal and distal edges;

(c) a third welded wire gridwork comprised of two planar panels, said panels being disposed in right angled relationship to one another and having integrally joined proximal edges defining a corner therebetween, said panels each being of rectangular configuration, having a free distal edge in spaced relationship to said corner, and side edges extending between said proximal and distal edges; and, (d) means for joining the panels of said first and second gridworks in edge-to-edge relationship to one another and to the panels of said third gridwork to define a three-dimensional rectangular volume between the gridworks for the containing of rock.

2. A combination according to claim 1 wherein:

(a) the panels of the first and second welded wire gridworks correspond in size; and;

(b) the third gridwork has one panel corresponding in size to one panel of the first and second gridworks and another panel of a length substantially greater than that of the panels of the first and second gridworks whereby said other panel extends laterally of the three-dimensional volume defined between the gridworks when joined.

3. A combination according to claim 1 or 2 further comprising:

(a) a fourth welded wire gridwork comprised of a single planar panel of a generally rectangular configuration; and, (b) means for joining said fourth gridwork to the first, second and third gridworks to close one side of the three-dimensional volume between the panels of the first, second and third gridworks.

4. A combination according to claim 1 wherein the rectangular configuration of the panels of the first, second and third gridworks is square.

5. A gabion comprising:

(a) a first welded wire gridwork comprised of two planar panels, said panels being disposed in right angled relationship to one another and having integrally joined proximal edges defining a corner therebetween, said panels each being of rectangular configuration, having a free distal edge in spaced relationship to said corner, and side edges extending between said proximal and distal edges;

(b) a second welded wire gridwork comprised of two planar panels, said panels being disposed in right angled relationship to one another and having integrally joined proximal edges defining a corner therebetween, said panels each being of rectangular configuration, having a free distal edge in spaced relationship to said corner, and side edges extending between said proximal and distal edges;

(c) a third welded wire gridwork comprised of two planar panels, said panels being disposed in right angled relationship to one another and having integrally joined proximal edges defining a corner therebetween, said panels each being of rectangular configuration, having a free distal edge in spaced relationship to said corner, sand side edges extending between said proximal and distal edges; and, (d) means joining the panels of said first and second gridworks in edge-to-edge relationship to one another and to the panels of said third gridwork to define a three-dimensional rectangular volume between the gridworks for the containing of rock.

6. A combination according to claim 5 wherein:

(a) the panels of the first and second welded wire gridworks correspond in size; and, (b) the third gridwork has one panel corresponding in size to one panel of the first and second gridworks and another panel of a length substantially greater than that of the panels of the first and second gridworks whereby said other panel extends laterally of the three-dimensional volume defined between the gridworks when joined.

7. A gabion according to claim 5 or 6 further comprising:

(a) a fourth welded wire gridwork comprised of a single planar panel of rectangular configuration; and, (b) means joining said fourth gridwork to the first, second and third gridworks to close one side of the three-dimensional volume between the panels of the first, second and third gridworks.

8. A gabion according to claim 5 wherein the rectangular configuration of the panels of the first, second and third gridworks is square.

9. A method of making a gabion, said method comprising:

(a) providing a first welded wire gridwork comprised of two planar panels disposed in right angled relationship to one another and having integrally joined proximal edges defining a corner therebetween, said panels each being of rectangular configuration, having a free distal edge in spaced relationship to said corner, and side edges extending between said proximal and distal edges;

(b) providing a second welded wire gridwork comprised of two planar panels disposed in right angled relationship to one another and having integrally joined proximal edges defining a corner therebetween, said panels each being of rectangular configuration, having a free distal edge in spaced relationship to said corner, and side edges extending between said proximal and distal edges;

(c) providing a third welded wire gridwork comprised of two planar panels disposed in right angled relationship to one another and having integrally joined proximal edges defining a corner therebetween, said panels each being of rectangular configuration, having a free distal edge in spaced relationship to said corner, and side edges extending between said proximal and distal edges; and, (d) joining the panels of said first and second gridworks in edge-to-edge relationship to one another and to the panels of said third gridwork to define a three-dimensional rectangular volume between the gridworks for the containing of rock.

10. A method according to claim 9 further comprising:

(a) providing a fourth welded wire gridwork comprised of a single planar panel of a generally rectangular configuration; and, (b) joining said fourth gridwork to the first, second and third gridworks to close one side of the three-dimensional volume between the panels of the first, second and third gridworks.

11. A method according to claim 9 wherein a panel of said third gridwork is of a length substantially greater than that of the panels of the first and second gridworks so as to extend laterally from the three-dimensional volume when the panels are joined.

12. A method according to claim 9 wherein the rectangular configuration of the panels of the first, second and third gridworks is square.

13. A method of constructing a retaining wall for an earthen formation, said method comprising:

(a) forming a plurality of gabions by the steps of:

(1) providing a plurality of welded wire gridworks each comprised of a pair of generally planar panels disposed in angled relationship to one another with proximal edges integrally joined to define a corner therebetween, free distal edges spaced from said corner, and side edges extending between said proximal and distal edges;

(2) joining the panels of said gridworks in edge-to-edge relationship to define a three-dimensional volume between said gridworks for the containing of rock;

(b) providing soil reinforcing grids secured to at least certain of said gabions to extend laterally from the volume defined between the panels thereof;

(c) assembling rock filled tiers of said gabions at the face of the earthen formation with the soil reinforcing grids provided on said certain gabions extending toward the formation; and, (d) backfilling soil between said tiers of gabions and the earthen formation to cover the reinforcing grids extending toward the formation.

14. A method according to claim 13 wherein the soil reinforcing grids provided on said certain gabions define a bottom for the volume defined between the panels of each of said certain gabions.

15. A method according to claim 13 wherein said tiers extend horizontally and are stacked upon one another.

16. A method according to claim 15 wherein the soil reinforcing grids extending from successive tiers are, at least in part, staggered relative to one another.

* * * * *

UNITED STATES PATENT AND TRADEMARK OFFICE

CERTIFICATE OF CORRECTION

PATENT NO. : 5,076,735

DATED : December 31, 1991

INVENTOR(S) : WILLIAM K. HILKIFER

It is certified that error appears in the above - identified patent and that said Letters Patent is hereby corrected as shown below:

In Col. 5, line 48, change "said" to --and--.

In Col. 6, line 49, change "sand" to --and--.

Signed and Sealed this

First Day of June, 1993

*Attest:*

Michael K. Kirk

MICHAEL K. KIRK

*Attesting Officer*

*Acting Commissioner of Patents and Trademarks*